US011109735B2

(12) United States Patent
Gunter et al.

(10) Patent No.: US 11,109,735 B2
(45) Date of Patent: Sep. 7, 2021

(54) WET-CLEANING APPLIANCE HAVING A CLEANING ROLLER

(71) Applicant: Vorwerk & Co. Interholding GmbH, Wuppertal (DE)

(72) Inventors: Christoph Gunter, Wuppertal (DE); Jochen Jentsch, Berlin (DE)

(73) Assignee: Vorwerk & Co. Interholding GmbH, Wuppertal (DE)

( * ) Notice: Subject to any disclaimer, the term of this patent is extended or adjusted under 35 U.S.C. 154(b) by 330 days.

(21) Appl. No.: 16/332,283

(22) PCT Filed: Jul. 31, 2017

(86) PCT No.: PCT/EP2017/069283
§ 371 (c)(1),
(2) Date: Apr. 1, 2019

(87) PCT Pub. No.: WO2018/024656
PCT Pub. Date: Feb. 8, 2018

(65) Prior Publication Data

US 2020/0008641 A1 Jan. 9, 2020

(30) Foreign Application Priority Data

Aug. 1, 2016 (DE) ..... 10 2016 114 169.0

(51) Int. Cl.
*A47L 11/282* (2006.01)
*A47L 11/40* (2006.01)
(Continued)

(52) U.S. Cl.
CPC ..... *A47L 13/22* (2013.01); *A47L 11/282* (2013.01); *A47L 11/4016* (2013.01);
(Continued)

(58) Field of Classification Search
CPC ..... A47L 11/28; A47L 11/282; A47L 11/29; A47L 11/30; A47L 11/302; A47L 11/33;
(Continued)

(56) References Cited

U.S. PATENT DOCUMENTS 4,875,246 A * 10/1989 MacGregor ..... A47L 11/185 15/98
6,026,529 A * 2/2000 Caruso ..... A47L 11/03 15/97.1
(Continued)

FOREIGN PATENT DOCUMENTS

BR WO 2010/028464 A1 * 9/2008 ..... B05C 11/039
DE 102 29 611 B3 1/2004

OTHER PUBLICATIONS

International Search Report of PCT/EP2017/069283, dated Nov. 22, 2017.
(Continued)

*Primary Examiner* — Orlando E Aviles
*Assistant Examiner* — Sarah Akyaa Fordjour
(74) *Attorney, Agent, or Firm* — Collard & Roe, P.C.

(57) ABSTRACT

A wet-cleaning appliance, in particular a wet mop, has a cleaning roller, which is mounted in a rotatable manner about a roller axis, and having a roller cover, which encloses the cleaning roller in the circumferential direction, at least in part, and has at least one movable covering element for optionally closing and/or releasing an opening region of the roller cover. In order to prevent residual liquid contained in the roller cover from dripping from the wet-cleaning appliance when the roller cover is opened, the movable covering element has a collecting unit, in particular a collecting container, which has a storage volume for collecting liquid that remains in the roller cover.

9 Claims, 5 Drawing Sheets

(51) Int. Cl.
*A47L 13/22* (2006.01)
*A47L 13/16* (2006.01)
*A47L 11/292* (2006.01)

(52) U.S. Cl.
CPC ..... *A47L 13/16* (2013.01); *A47L 11/292* (2013.01); *A47L 11/4011* (2013.01); *A47L 11/4041* (2013.01); *A47L 11/4077* (2013.01)

(58) Field of Classification Search
CPC ..... A47L 11/4013; A47L 11/401; A47L 11/4041; A47L 11/4077; A47L 11/4083; A47L 9/04; A47L 9/28; A47L 9/0411; A47L 9/0433; A47L 9/0477; A47L 9/2847; A47L 13/22; A47L 13/16; B05C 17/22
USPC ..... 15/50.3, 52, 52.3, 52.1, 98, 103.5, 15/230.11, 248.2
See application file for complete search history.

(56) References Cited

U.S. PATENT DOCUMENTS 8,677,543 B2 * 3/2014 Wilkins ..... B08B 1/04 15/24
10,820,774 B2 * 11/2020 Lindenbeck ..... A47L 13/42
2015/0107038 A1 * 4/2015 Lee ..... A47L 25/005 15/104.002
2015/0313431 A1 11/2015 Eriksson

OTHER PUBLICATIONS

English translation of the International Preliminary Report on Patentability and Written Opinion of the International Searching Authority in PCT/EP2017/069283, dated Feb. 14, 2019.

* cited by examiner 4
5
2
3
19
18
12
6
8
20
9
7
r 4
5
7
3
9
20
8
19
18
12
6
2
r 4
5
2
3
19
18
12
α
8
20
9
7
r 4
5
3
2
19
18
12
6
7
9
8
20
r

WET-CLEANING APPLIANCE HAVING A CLEANING ROLLER

CROSS REFERENCE TO RELATED APPLICATIONS

This application is the National Stage of PCT/EP2017/069283 filed on Jul. 31, 2017, which claims priority under 35 U.S.C. § 119 of German Application No. 10 2016 114 169.0 filed on Aug. 1, 2016, the disclosures of which are incorporated by reference. The international application under PCT article 21(2) was not published in English.

FIELD OF TECHNOLOGY

The invention relates to a wet cleaning appliance, in particular to a wet mop, with a cleaning roller mounted so that it can rotate around a roller axis and a roller cover that at least partially encloses the cleaning roller in a circumferential direction, which has at least one displaceable covering element for optionally closing and/or opening an opening region of the roller cover.

PRIOR ART

Wet cleaning appliances of the aforementioned kind are known in prior art.

For example, DE 102 29 611 B3 discloses a wet cleaning appliance with a wiping body that can be driven so as to rotate around a rotational axis, in which a cleaning liquid is removed from a supply tank and sprayed onto the surface of the wiping body by means of spray nozzles arranged in the direction of the rotational axis of the wiping body. The wiping body moistened in this way is guided over a surface to be cleaned during a wiping operation, wherein the wiping body picks up dirt from the surface to be cleaned.

During the wiping operation, the wiping body is increasingly loaded with dirt, thereby necessitating a regeneration. To this end, the wiping body is lifted from the surface to be cleaned, enclosed by a housing and sprayed with unused cleaning liquid. The wiping body rotates, so that cleaning liquid and dirt are driven out of the wiping body, hit the interior side of the housing, and are transferred into a collecting tank for dirty liquid.

After the regenerating operation is complete, residual cleaning liquid usually remains inside of the housing, which can then drip back onto the freshly cleaned surface when the housing is subsequently opened. This detracts from the wiping result achieved beforehand.

SUMMARY OF THE INVENTION

Therefore, the object of the invention is to create a wet cleaning appliance that prevents any liquid that might be in the roller cover from dripping off.

In order to achieve the aforementioned object, it is proposed that the displaceable covering element have a storage volume-providing collecting unit, in particular a collecting vessel, for collecting liquid remaining behind inside of the roller cover.

According to the invention, a collecting unit is now arranged on the displaceable covering element, into which the liquid remaining behind inside of the roller cover can flow. Given a displacement of the covering element from a closed position of the covering element into an opening position of the covering element, gravity here causes the liquid to flow along an inner wall of the covering element toward the collecting unit, where the liquid is collected, and can thus not drip off of the roller cover. The collecting unit is here advantageously designed like a collecting vessel. The collecting vessel can have a single chamber or also several chambers, in which the liquid is collected. The free volume of the chamber or chambers here determines the storage volume of the collecting unit, i.e., the amount of liquid that can be accommodated in the collecting unit. The collecting unit can be designed as a single part with the covering element, for example in the form of a shared injection molded part. Alternatively, the collecting unit can be arranged on the covering element as a separately manufactured element, for example via connecting techniques such as adhesive bonding, welding, latching and the like, wherein priority is to be given to those fastening methods which provide a fluid-tight connection between the covering element and collecting unit.

It is proposed that the collecting unit be arranged offset radially inward on an inner wall of the covering element facing the cleaning roller. The collecting unit is thus located directly in the flow path of the liquid, which flows along the inner wall of the covering element. The collecting unit preferably is located in the circumferential direction of the covering element at the end region of the covering element which in the completely open state of the roller cover represents a deepest point of the covering element displaced into the opening position. This ensures that the liquid cannot escape the collecting unit, but rather is captured in an upright container. The radial width of the collecting unit is preferably smaller than the radial distance between the cleaning roller and covering element, so that the covering element can be displaced without the collecting unit rubbing against the cleaning roller. For example, the collecting unit can have a radial width of a few millimeters, e.g., 5 mm to 10 mm, wherein a radial free space of preferably at least 2 mm should remain between the collecting unit and cleaning roller, so as to absorb changes in the diameter of the cleaning roller, for example owing to centrifugal force-dependent deformations.

It is proposed that the collecting unit be designed to hold liquid in an amount of up to 30 ml. At an exemplary overall amount of liquid in the wet cleaning appliance of 250 ml, a collecting unit with a capacity of up to 30 ml is sufficient for being able to reliably accommodate the residual liquid remaining in the roller cover after a regeneration process of the cleaning roller. In addition, the entire available amount of liquid in the wet cleaning appliance is usually not used all at once for wetting the cleaning roller. For this reason, the percentage of liquid that is not centrifuged from the cleaning roller to a collecting tank for dirty liquid during the regeneration operation usually measures only a very small fraction of the overall liquid amount. Therefore, dripping is reliably prevented if the collecting unit can hold up to 30 ml of liquid, possibly even less, for example only 20 ml or only 10 ml.

It is proposed that the collecting unit have an opening that precedes the storage volume in an opening direction of the roller cover. The collecting unit preferably designed as a collecting vessel thus has an opening that is also displaced during the displacement of the covering element in such a way that the opening is arranged above the storage volume in the opening position of the covering element (relative to a vertical). This ensures that the liquid cannot exit the collecting unit. By contrast, the opening can again get under a plane of the storage volume as the covering element is displaced back into the closed position, so that liquid can escape from the collecting unit onto the inner wall of the covering. This can take place so that the liquid remaining in the roller cover given a previous regeneration operation can again be centrifuged by the rotation of the cleaning roller to a collecting tank during the next regeneration operation. Alternatively, however, the opening of the collecting unit could also come after a portion of the storage volume (relative to the opening direction). However, it is advantageous in this embodiment that the opening of the collecting unit has allocated to it a channel, a liquid line or the like, which empties into a collecting tank for dirty liquid. Of course, the collecting unit can in both cases also have several openings, which can also be arranged at varying heights.

It is proposed that the collecting unit be formed along the entire axial longitudinal extension of the covering element. In this embodiment, it is especially easy to guide the liquid located along the entire axial length of the roller cover on the inner wall of the covering element or the entire roller cover into the collecting unit in an equally optimal manner. Therefore, it is not necessary to provide additional liquid conducting devices on the inner wall of the covering element, which guide the liquid to the collecting unit. Rather, gravity always takes the liquid located on the inner wall into the collecting unit when the opening region of the roller cover is opened. This effectively prevents liquid from dripping from the roller cover over the entire axial length of the roller cover.

It is proposed that the collecting unit be formed in the circumferential direction of the covering element over an angular section of 30° to 90°. The proposed size of the angular section of 30° to 90° is especially suitable for covering elements that can be displaced by roughly 180°, so as to optionally open or close the opening region. With the cleaning roller idle, the liquid flows to the deepest point inside of the roller cover. With the roller cover closed, the collecting unit should preferably not be arranged precisely there, since liquid dripping vertically downward directly from the cleaning roller will otherwise drip onto an outer wall of the collecting unit, and from there can get onto a freshly cleaned surface when the opening region is subsequently opened. If the collecting unit covers only 30° to 90° of a circumferential section of the covering element as proposed, enough of an angular section exists, which remains free for the liquid to drip off next to the collecting unit. It is especially recommendable that the collecting unit not be arranged vertically under the cleaning roller in the closed position of the roller cover, but rather be offset by an angle, for example by an angle of preferably at least 30° relative to an angle between a vertical direction and a plane in which the opening of the collecting unit is arranged.

Alternatively or additionally to the collecting unit proposed above, which extends along the entire axial longitudinal extension of the covering element, it is proposed that the wet cleaning appliance have at least one collecting unit, which at the end side is arranged on the covering element in relation to an axial direction. According to this embodiment, the liquid remaining behind inside of the roller cover is collected in an end-side collecting unit of the covering element. Both axial end sides of the covering element advantageously have a collecting unit. Instead of on the covering element itself, the collecting unit can alternatively also be arranged on or in a portion of the roller cover that is fixed relative to the housing of the wet cleaning appliance or on or in the appliance housing. In the event that a collecting unit is arranged at each axial end side of the roller cover, each of the collecting units can preferably accommodate liquid in the amount of up to 15 ml, so that the total amount of liquid that can be accommodated measures up to 30 ml. The collecting unit or collecting units can be detachably arranged on the covering element or roller cover like a type of end-side cap. This makes it possible to remove the collecting unit from the wet cleaning appliance, so that the collecting unit can be easily cleaned by a user of the wet cleaning appliance, especially so as to remove accumulated dirt from time to time.

It is further proposed that an inner wall of the covering element have a feed ramp that is inclined against a horizontal and in particular extends from the middle of an axial longitudinal extension of the covering element to the end-side collecting unit, which is designed in such a way that gravity guides the liquid located inside of the roller cover into the end-side collecting unit when the covering element is displaced into an opening direction. Rotating the covering element around the roller axis allows the liquid located on the inner wall of the covering element to flow onto the feed ramp, and from there along a gradient during the continued displacement of the covering element in the opening direction to the collecting unit. The gradient of the feed ramp here relates to an orientation of the feed ramp at a deepest point of the roller cover, which in the closed position of the roller cover is arranged directly under the cleaning roller in a vertical direction. In the event that both axial end sides of the covering element have a collecting unit, it is recommended that the covering element have two feed ramps, which are arranged mirror symmetrically to a plane that in the middle of the roller axis runs perpendicular to the roller axis. The liquid flowing along the inner wall of the covering element can thus get to one of the collecting units regardless of the axial initial position on the inner wall. Given a position of the covering element in which the feed ramp lies at a deepest point of the covering element, the liquid can flow onto the feed ramp, and from there get into the collecting unit as the covering element and feed ramp rotate.

It is proposed that the collecting unit have a discharge opening, which can be connected with a collecting tank by rotating the covering element in the opening direction, so that liquid collected in the collecting unit can be transferred into the collecting tank. According to this embodiment, the liquid is thus first collected in the collecting unit, and only drained through the discharge opening in the open position of the roller cover, since it is—at the latest then—connected with the collecting tank. Proceeding from the closed position of the covering element, the liquid is thus first guided inside of the covering element into the collecting unit via the feed ramp, remains there as the covering element continues its displacement from the closed position into the open position, and is finally transferred into the collecting tank for dirty liquid through the discharge opening once the open position has been reached. As a consequence, when the roller cover is again opened for a next wiping operation, the collecting unit is evacuated, and no more liquid can drip from the roller cover onto a cleanable or freshly cleaned surface.

The functional principle according to which the collecting unit initially accommodates and stores the liquid, and then transfers it into a collecting tank, can be provided independently of whether the collecting unit is arranged along the entire longitudinal extension of the covering element, or alternatively in an axial end region of the covering element. In this conjunction, it can also be provided that the covering element or roller cover have collecting units formed both in the axial direction and on the end side, which are interconnected by channels, liquid lines and the like, and can be emptied into a collecting tank via a shared discharge opening.

Finally, it is proposed that the covering element can be displaced relative to the roller axis by at least 130°, preferably by 135° to 180°. This proposed swiveling range of the covering element is sufficient for opening the roller cover enough for displacing the cleaning roller onto a surface to be cleaned on the one hand, and being able to collect liquid flowing in the direction of a deepest point of the roller cover or covering element in the collecting unit on the other.

Within the meaning of the invention, the term wet cleaning appliance is to be construed as comprising those appliances that also enable wet cleaning, whether exclusively or among other functions. These include on the one hand the hand-guided and automatically traversable wet cleaning appliances, in particular also cleaning robots, and on the other hand combined dry and wet cleaning appliances, which can perform both a wet cleaning and dry cleaning process. Also meant apart from conventional floor cleaning appliances for cleaning a floor are wet cleaning appliances for cleaning surfaces above the floor. For example, these include appliances for washing windows, cleaning shelves, stairs and the like.

BRIEF DESCRIPTION OF THE DRAWINGS

The invention will be explained in more detail below based on exemplary embodiments. Shown on.

DESCRIPTION OF THE EMBODIMENTS

Figure 1:
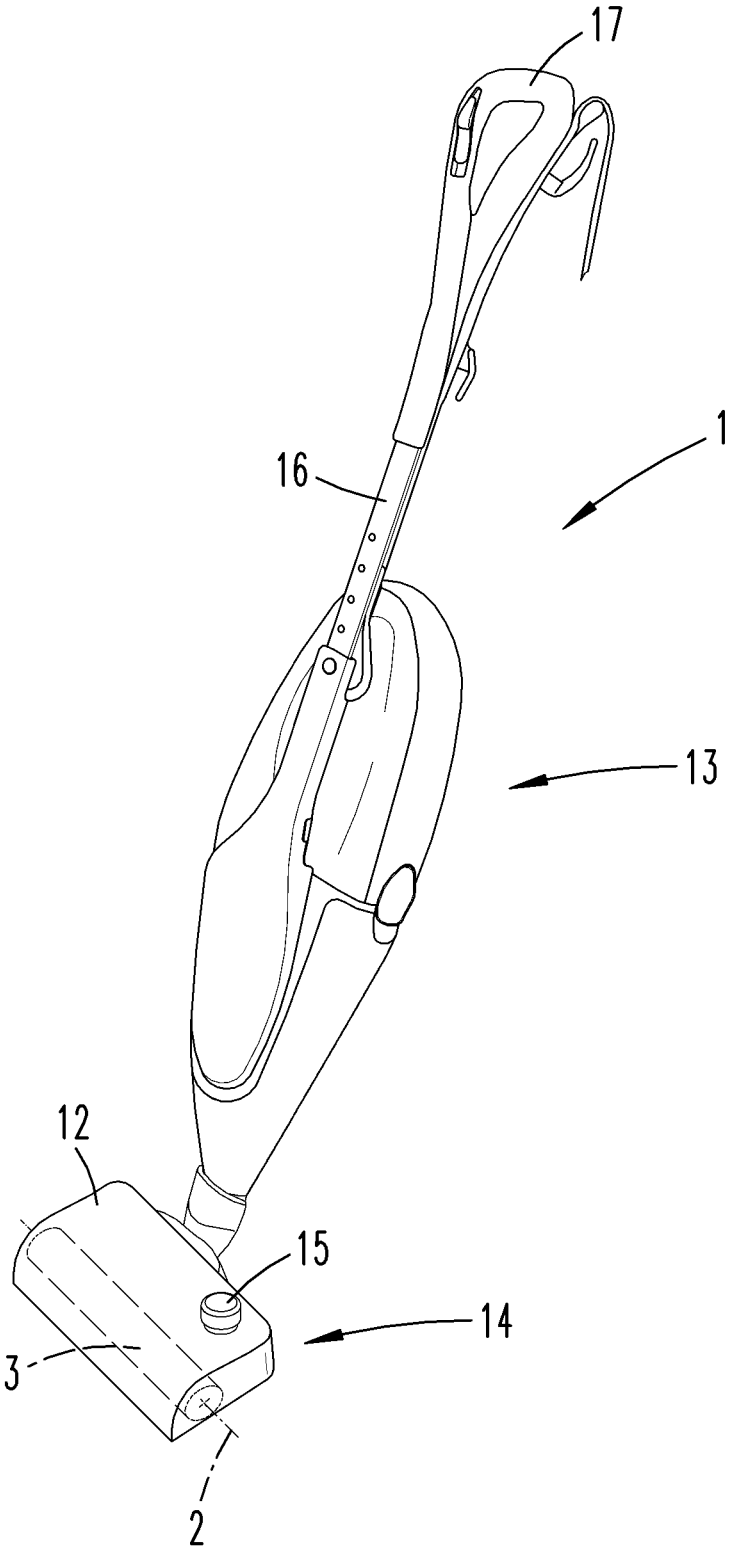
FIG. 1 is a wet cleaning appliance according to the invention.

FIG. 1 shows a wet cleaning appliance 1, which is here designed as a wet mop with a base device 13 and an attachment 14. Arranged on the base device 13 is a stalk 16 with a handle 17, by means of which a user can guide the wet cleaning appliance 1 over a surface to be cleaned. The stalk 16 here advantageously has a telescoping design, so that a user can adjust the height of the wet cleaning appliance 1 to his or her body size. During a conventional wiping operation, the user displaces the wet cleaning appliance 1 back and forth over the surface to be cleaned, wherein he or she alternately pushes the wet cleaning appliance 1 out and pulls it back.

The attachment 14 has an appliance housing 12, in which a tank (not shown) for cleaning fluid is arranged. Liquid can be filled into the tank via a filler 15. Also arranged in the appliance housing 12 is a cleaning roller 3, which can be rotated around a roller axis 2. The roller axis 2 is essentially perpendicular to a conventional direction of movement of the wet cleaning appliance 1. The liquid can be dispensed from the tank onto the surface of the cleaning roller 3 so as to moisten the latter.

During a wiping operation, the cleaning roller 3 rotates around the roller axis 2, so that the circumferential surface of the cleaning roller 3 continuously rolls onto the surface to be cleaned. The cleaning roller 3 is usually wound with a cleaning layer, if necessary with a sponge body that stores additional liquid interspersed. For example, the cleaning layer is here a textile cleaning cloth. During the wiping operation, dirt continues to accumulate on the cleaning roller 3, i.e., the cleaning layer. For this reason, it may become necessary to regenerate the cleaning roller 3 after a certain operating period, wherein dirt and liquid loaded with dirt are removed from the cleaning roller 3 during a regeneration operation. For this purpose, the cleaning roller 3 is usually rotated with a speed that is higher than the speed of the cleaning roller 3 during a wiping operation. This causes dirt and liquid loaded with dirt to be spun off of the cleaning roller 3. The sprayed off liquid can be collected and fed to a collecting tank.

Figure 2:
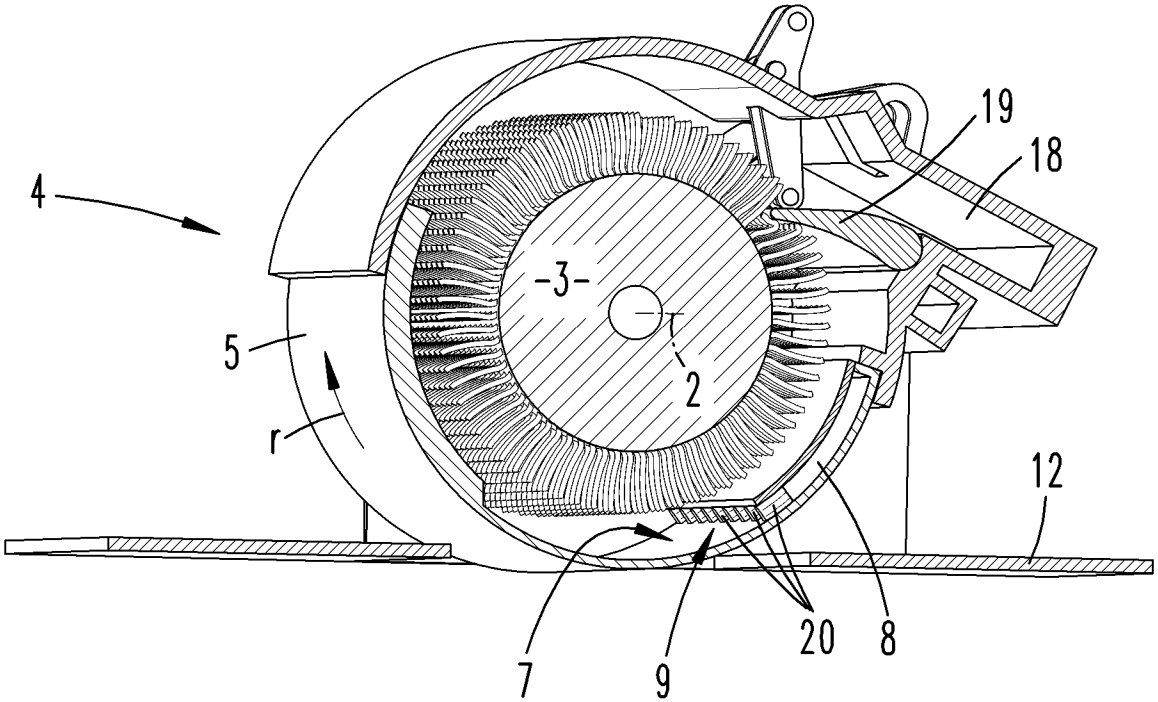
FIG. 2 is a perspective view of a cleaning roller with a surrounding roller cover.

FIG. 2 shows a partial region of the appliance housing 12 of the attachment 14, in which the cleaning roller 3 is held so that it can rotate around the roller axis 2. The roller axis 2 simultaneously forms a rotational axis for a displaceable covering element 5 of a roller cover 4, which surrounds the cleaning roller 3 in the circumferential direction. The covering element 5 can be displaced relative to a fixed part of the roller cover 4 in an opening region 6 of the roller cover 4, so as to preferably completely close the roller cover 4 in the circumferential direction of the cleaning roller 3. The closed position of the covering element 5 or roller cover 4 depicted on FIG. 2 corresponds to the position during a regeneration operation of the wet cleaning appliance 1, in which dirt and liquid are spun off of the cleaning roller 3 and transferred into a collecting tank. In order to reset the wet cleaning appliance 1 for a conventional wiping operation again proceeding therefrom, the covering element 5 is displaced from the opening region 6 of the roller cover 4, so that the cleaning roller 3 can be displaced out of the roller cover 4 in the direction of a surface to be cleaned. Usually provided for this purpose are a drive motor and a gearbox, which initiate the displacement of the covering element 5 and, if necessary, the cleaning roller 3 (not shown) as well.

A regeneration operation of the wet cleaning appliance 1 is introduced by displacing the covering element 5 until the cleaning roller 3 is completely housed by the roller cover 4 in the circumferential direction. The cleaning roller 3 is then strongly accelerated, if necessary after or while adding liquid. The high speed of the cleaning roller 3, which should be higher than the speed of the cleaning roller 3 during a wiping operation, spins the liquid and dirt out of the cleaning roller 3. In addition, a stripping device 19 can be provided, which touches the surface of the cleaning roller 3 and also supports regeneration. The rotation of the cleaning roller 3 simultaneously produces a flow of ambient air, which supports the transport of liquid and dirt in the direction of a collecting channel 18. As a consequence, an optimal overall regeneration result is achieved.

For the subsequent wiping operation, the roller cover 4 is again opened by displacing the covering element 5 in the opening direction r around the roller axis 2, and allowing the cleaning roller 3 to exit the appliance housing 12 and come into contact with a surface to be cleaned.

During the displacement of the covering element 5 in the opening direction r, residual liquid that was not transferred into the collecting channel 18 during the regeneration operation flows along an inner wall 7 of the covering element 5 to a respective currently deepest point of the roller cover 4 or covering element 5. An end region of the covering element 5 adjacent to the opening region 6 of the roller cover 4 has a collecting unit 8, which is here designed as a collecting vessel, which is arranged radially inwardly offset proceeding from the inner wall 7. The collecting unit 8 provides a storage volume for the liquid to be accommodated. For example, liquid in the amount of 20 ml can here be accommodated. Since only liquid amounts of a few milliliters remain behind inside of the roller cover 4 after a regeneration operation of the cleaning roller 3, the collecting unit 8 is large enough to be able to accommodate this amount of liquid.

Figure 6:
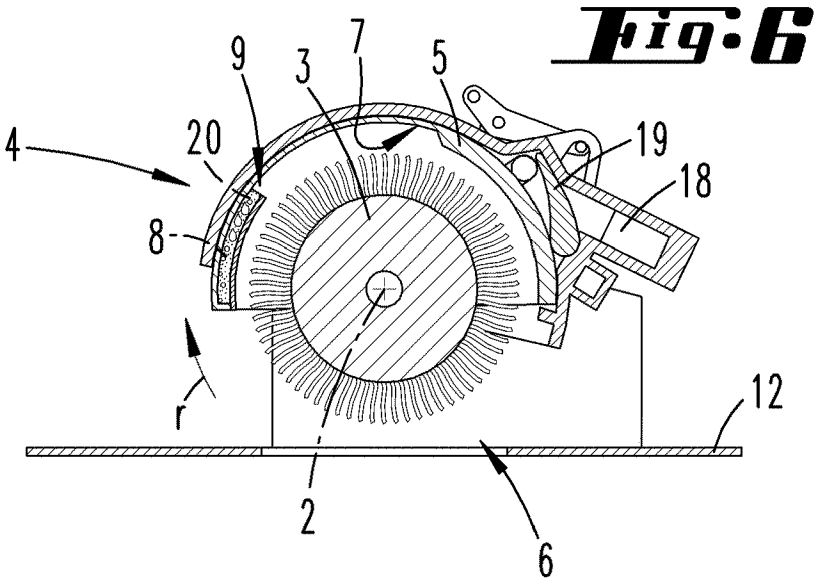
FIG. 6 is the roller cover in an open position.

How the collecting unit 8 functions will be explained in greater detail below based on FIGS. 3 to 6. These show the covering element 5 of the roller cover 4 proceeding from a closed position (FIG. 3) given a displacement in the direction of an open position (FIG. 6).

Figure 3:
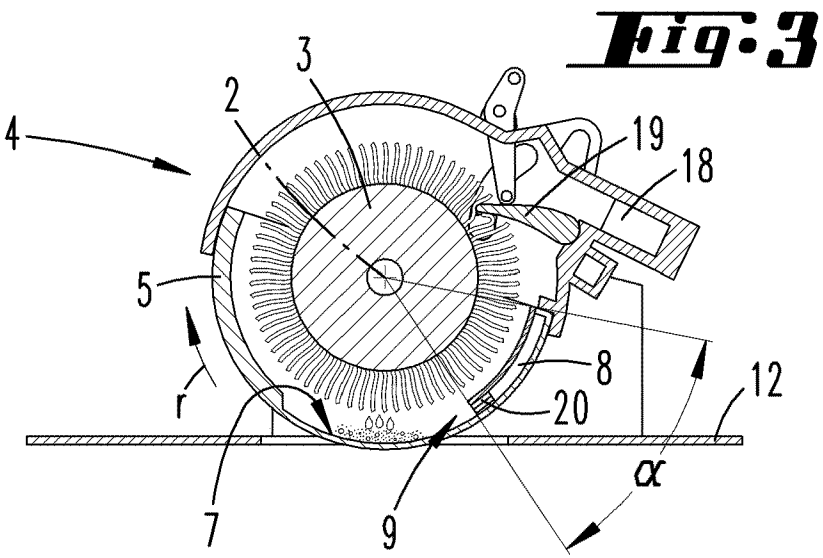
FIG. 3 is the roller cover according to FIG. 2 in the closed position.

On FIG. 3, the covering element 5 is in the closed position, in which the roller cover 4 completely envelops the cleaning roller 3 in a circumferential direction. At the point in time depicted, a regeneration operation of the wet cleaning appliance 1 has ended, and a majority of the liquid of the cleaning roller 3 has been transferred into the collecting channel 18. Only a small portion of residual liquid (not shown to scale on the figures) remains inside of the roller cover 4, and is made to accumulate at a deepest point on the inner wall 7 of the covering element 5 through exposure to gravity. In the closed position of the covering element 5, the collecting unit 8 arranged on the covering element 5 is located completely above the deepest point at which the liquid and possibly dirt have accumulated in relation to a vertical direction. The collecting unit 8 is here formed along the entire longitudinal extension of the cleaning roller 3 (not visible in the sectional view shown). The collecting unit 8 extends in a circumferential direction over an angular section $\alpha$ of the covering element 5 that occupies roughly 45°. This corresponds to one fourth of the angular range occupied by the entire covering element 5, which here measures 180°.

Figure 4:
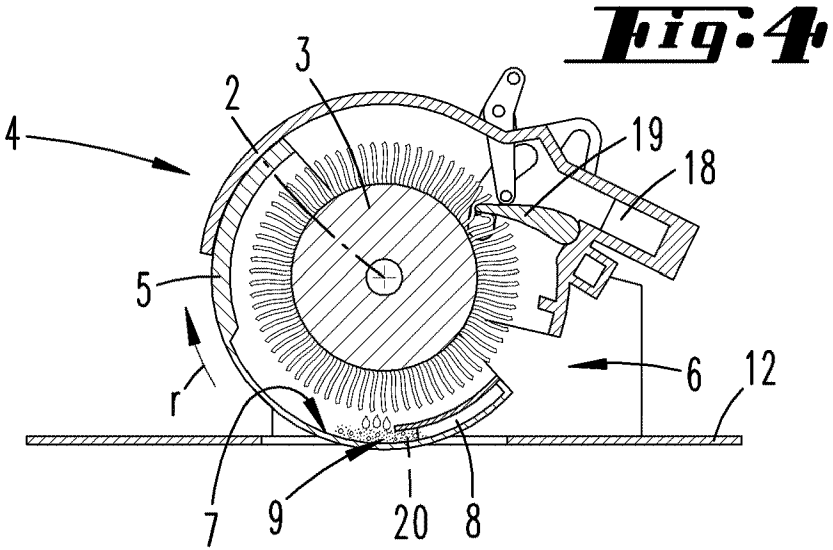
FIG. 4 is the roller cover in a partially open position.

FIG. 4 shows a position of the roller cover 4 in which the covering element is displaced in the opening direction r in such a way as to at least partially release the opening region 6. In this position, the opening 9 of the collecting unit 8 is located roughly in the region of the deepest point of the roller cover 4, so that the liquid accumulated at the deepest point can flow into the collecting unit 8.

Figure 5:
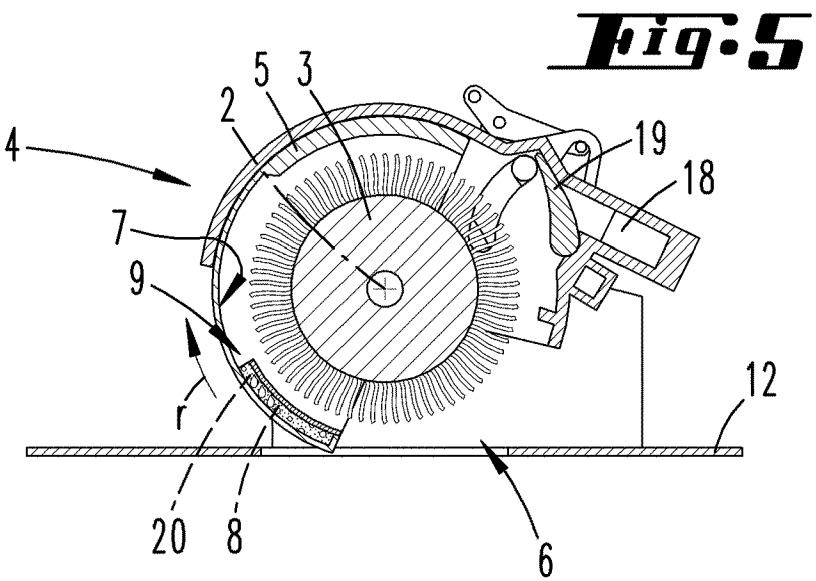
FIG. 5 is the roller cover in a more open position relative to FIG. 4.

As the covering element 5 continues to be displaced in the opening direction r, the opening region 6 opens noticeably, as depicted on FIG. 5. The collecting unit 8 now has now exceeded the deepest point, and is located in a position in which the opening 9 of the collecting unit 8 is arranged at a higher level than the liquid collected in the collecting unit 8. In this position, the liquid can no longer escape the collecting unit 8, and thus also not drip onto the surface to be cleaned.

In the open position shown on FIG. 6, the opening region 6 of the roller cover 4 is maximally opened. This is the position which the roller cover 4 has during the wiping operation of the wet cleaning appliance 1.

If the roller cover 4 closes again proceeding from the open position shown on FIG. 6, the liquid again flows out of the collecting unit 8 and onto the inner wall 7 of the covering element 5. During the subsequent regeneration operation of the cleaning roller 3, the liquid is once more accelerated through the rotating cleaning roller 3, and along with additional liquid spun off of the cleaning roller gets to the collecting channel 18, and from there into a collecting tank for contaminated liquid. After the regeneration operation has ended, residual liquid possibly remains behind again inside of the roller cover 4, which is likewise again collected in the collecting unit 8 when the roller cover 4 is opened. The amount of liquid that remains behind is thus not increased by sequential regeneration cycles. Rather, the residual liquid of a preceding regeneration operation is only temporarily stored in the collecting unit 8, and again released during the ensuing regeneration operation, so that it can merge with the liquid that is spun off of the cleaning roller 3 anew, and get to the collecting channel 18. As a consequence, an equilibrium is established for the liquid remaining behind inside of the roller cover 4.

Since the collecting unit 8 is designed in an axial direction along the entire longitudinal extension of the cleaning roller 3 or roller cover 4, liquid can be transferred from each region of the cleaning roller 3 into the collecting unit 8, without special guiding devices being necessary. Rather, the liquid spun off of the cleaning roller 3 follows the curvature of the inner wall 7 in the direction of the deepest point of the covering element 5, where it is collected and can finally be transferred into the collecting unit 8 while displacing the covering element 5 in the opening direction r.

Figure 7:
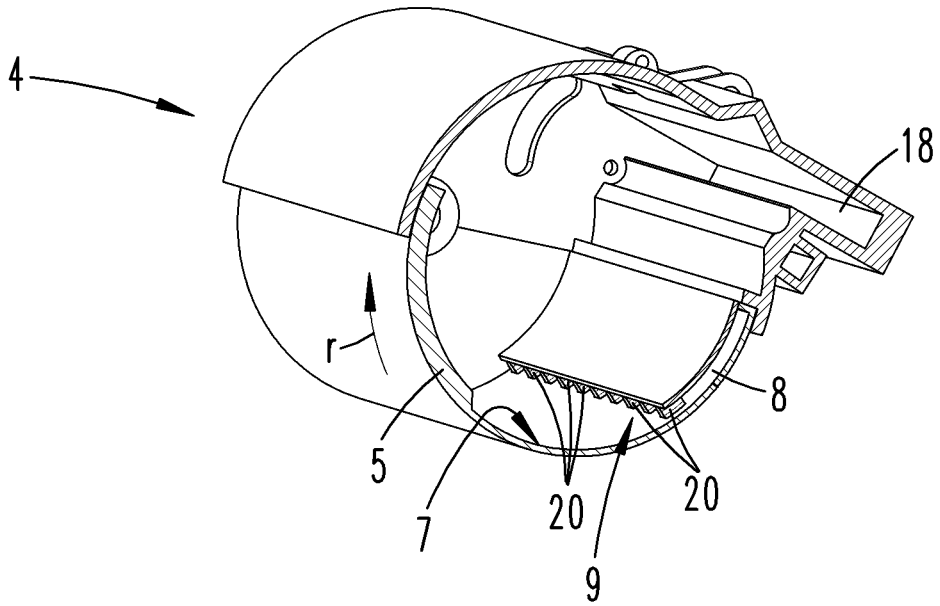
FIG. 7 is the roller cover according to FIG. 2 depicted separately.

FIG. 7 shows the roller cover 4 in isolation, i.e., without the cleaning roller 3 arranged therein. The roller cover 4 is located in the closed position, in which the covering element 5 completely seals the opening region 6 of the roller cover 4. The collecting channel 18 is discernible, through which liquid can get into a collecting tank of the wet cleaning appliance 1. The collecting channel 18 is integrally formed with the roller cover 4, for example in an injection molding process. The opening 9 of the collecting unit 8 precedes the storage volume of the collecting unit 8 relative to the opening direction r of the covering element 5. In addition, the opening 9 has a plurality of webs 20, which are arranged one next to the other in an axial direction of the covering element 5, and along which the liquid can flow into the collecting unit 8.

Figure 8:
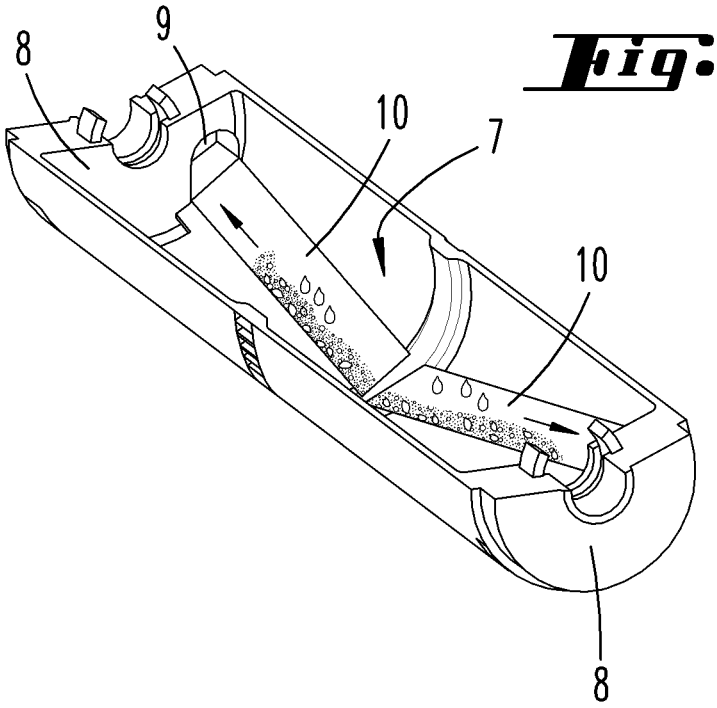
FIG. 8 is a displaceable covering element of the roller cover according to an alternative embodiment.

FIG. 8 shows a covering element 5 of a roller cover according to another embodiment. The depicted covering element 5 has end-side collecting units 8 in relation to an axial direction. Liquid can flow into these collecting units 8 from an inner wall 7 of the covering element 5 through openings 9. Arranged on the inner wall 7 of the covering element 5 for each of the covering units 8 is a respective feed ramp 10, which extends from a center of the longitudinal extension of the covering element 5 to the respective collecting unit 8. In the position of the covering element 5 shown on FIG. 8, the feed ramp 10 has a gradient, over which liquid can flow from the inner wall 7 of the covering element 5 to the opening 9 of the respective collecting unit 8 during a rotation of the covering element 5. Displacing the covering element 5 from the closed position into the open position also causes the respective feed ramp 10 to be displaced, wherein the orientation of the feed ramp 10 changes relative to the effective direction of gravity. The liquid collected in the collecting unit 8 can no longer flow back through the opening 9 onto the feed ramp 10 or the inner wall 7 of the covering element 5 in the open position of the covering element 5. As a result, the liquid is captured in the collecting unit 8, and cannot drip onto a surface to be cleaned in the open position of the roller cover 4.

Figure 10:
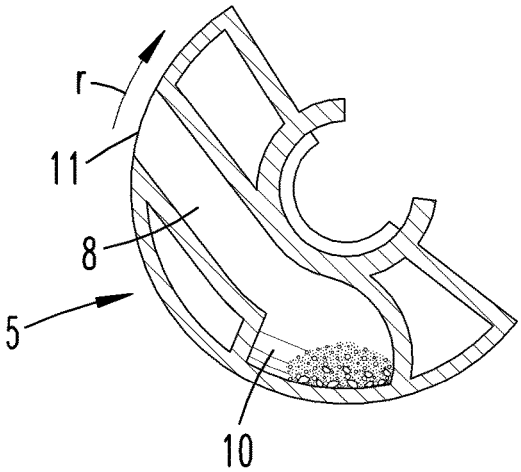
FIG. 10 is the covering element in a partially open position.
Figure 11:
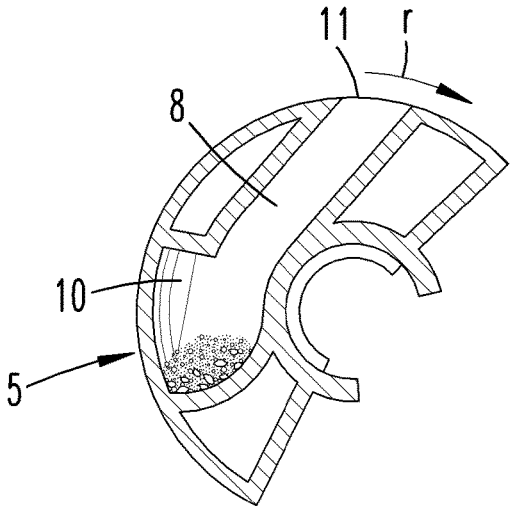
FIG. 11 is the covering element in a more open position relative to FIG. 10.
Figure 12:
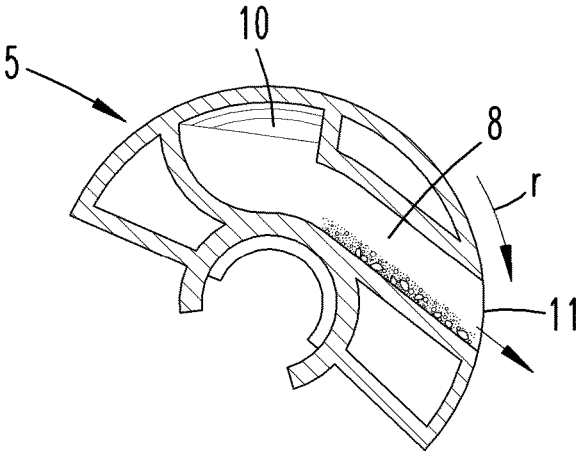
FIG. 12 is the covering element in the open position.

In order to illustrate the function, FIGS. 9 to 12 show a radial cross section through a collecting unit 8 during a rotation of the covering element 5 from a closed position (FIG. 9) into an open position (FIG. 12).

Figure 9:
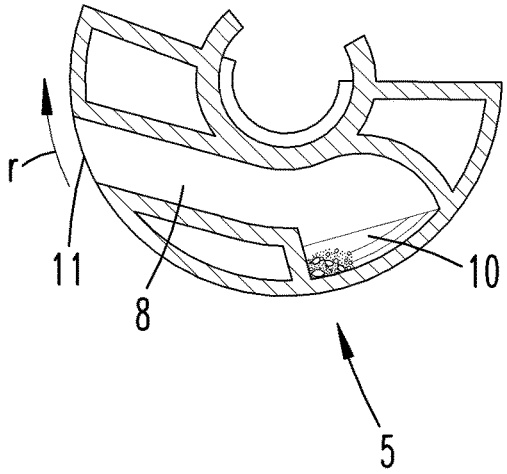
FIG. 9 is a radial section through the covering element according to FIG. 8 in a closed position.

In the closed position of the covering element 5 according to FIG. 9, the feed ramp 10 ascends in the direction of the opening 9 of the collecting unit 8, so that residual liquid located inside of the roller cover 4 cannot yet flow from the inner wall 7 of the covering element 5 via the feed ramp 10 into the collecting unit 8. The liquid or possibly even dirt collects at initially a deepest point inside of the covering element 5.

Given a displacement of the covering element 5 into the opening direction r as depicted on FIG. 10, the deepest point of the covering element 5 or feed ramp 10 is also displaced, so that the collected liquid can get into the collecting unit 8 during the displacement.

FIG. 11 shows a time during a continued (relative to FIG. 10) displacement of the covering element 5 in the opening direction r. The liquid is here now under the feed ramp 10 in relation to a vertical direction.

Finally, FIG. 12 shows the position of the covering element 5 with the opening region 6 of the roller cover 4 completely open. In this position, the liquid collected in the collecting unit 8 is located above a discharge opening of the collecting unit 8 in relation to a vertical direction, so that the liquid contained in the collecting unit 8 can flow out of the collecting unit 8. The collecting channel 18 of the attachment 14 preferably follows the discharge opening 11 of the collecting unit 8 in the opening position of the covering element 5, so that the liquid can be transferred from the collecting unit 8 into a collecting tank for dirty liquid.

Even though the invention was exemplarily described in relation to a hand-guided wet cleaning appliance 1, the wet cleaning appliance 1 can of course also be a cleaning robot. In addition, the wet cleaning appliance 1 can also be a combined wiping and vacuuming device or a wet cleaning appliance 1 that can exclusively perform a wet cleaning task.

REFERENCE LIST

1 Wet cleaning appliance
2 Roller axis
3 Cleaning roller
4 Roller cover
5 Covering element
6 Opening region
7 Inner wall
8 Collecting unit
9 Opening
10 Feed ramp
11 Discharge opening
12 Appliance housing
13 Base device
14 Attachment
15 Filler
16 Stalk
17 Handle
18 Collecting channel
19 Stripping device
20 Web
α Angular section
r Opening direction

The invention claimed is:

1. A wet cleaning appliance (1), with a cleaning roller (3) mounted so that it can rotate around a roller axis (2) and a roller cover (4) that completely encloses the cleaning roller (3) in a circumferential direction during a regeneration operation of the wet cleaning appliance (1), which has at least one displaceable covering element (5) for selectively closing and opening an opening region (6) of the roller cover (4) during a wiping operation of the wet cleaning appliance (1), wherein the displaceable covering element (5) has a storage volume-providing collecting unit (8) in the form of a collecting vessel, for collecting liquid remaining behind inside of the roller cover (4), and being arranged on the displaceable covering element (5), wherein with regard to a closed position of the covering element (5), the collecting unit (8) is located completely above a deepest point of the closed covering element (5), and wherein the collecting unit (8) has an opening (9) that faces in a direction of the deepest point of the closed covering element (5) and precedes the storage volume in an opening direction (r) of the roller cover (4).

2. The wet cleaning appliance (1) according to claim 1, wherein the collecting unit (8) is arranged offset radially inward on an inner wall (7) of the covering element (5) facing the cleaning roller (3).

3. The wet cleaning appliance (1) according to claim 1, wherein the collecting unit (8) is designed to hold liquid in an amount of up to 30 ml.

4. The wet cleaning appliance (1) according to claim 1, wherein the collecting unit (8) is formed along the entire axial longitudinal extension of the covering element (5).

5. The wet cleaning appliance (1) according to claim 1, wherein the collecting unit (8) is formed in the circumferential direction of the covering element (5) over an angular section (α) of 30° to 90°.

6. The wet cleaning appliance (1) according to claim 1, wherein the collecting unit (8), has an end side that is arranged on an end side of the covering element (5) in relation to an axial direction.

7. The wet cleaning appliance (1) according to claim 6, wherein an inner wall (7) of the covering element (5) has a feed ramp (10) that is inclined against a horizontal and in particular extends from the middle of an axial longitudinal extension of the covering element (5) to the end-side collecting unit (8), which is designed in such a way that gravity guides the liquid located inside of the roller cover (4) into the collecting unit (8) when the covering element (5) is displaced into an opening direction (r).

8. The wet cleaning appliance (1) according to claim 1, wherein the collecting unit (8) has a discharge opening (11), which can be connected with a collecting tank by rotating the covering element (5) in the opening direction (r), so that liquid collected in the collecting unit (8) can be transferred into the collecting tank.

9. The wet cleaning appliance (1) according to claim 1, wherein the covering element (5) can be displaced relative to the roller axis (2) by at least 130°.

* * * * *